United States Patent [19]

Hellier

[11] Patent Number: 4,519,407

[45] Date of Patent: May 28, 1985

[54] METHOD AND APPARATUS FOR TREATING TOBACCO

[76] Inventor: John A. Hellier, 20 Leslie La., Katonah, N.Y. 10563

[21] Appl. No.: 503,932

[22] Filed: Jun. 13, 1983

[51] Int. Cl.[3] ..... A24B 3/18

[52] U.S. Cl. ..... 131/291; 131/290; 131/304; 131/306; 131/900; 198/339; 198/496

[58] Field of Search ..... 131/290, 291, 300, 302, 131/304, 306, 309, 900, 902; 198/493, 496, 339; 99/323.9, 323.7

[56] References Cited

U.S. PATENT DOCUMENTS

| | | | |
|---|---|---|---|
| 620,139 | 2/1899 | Hysore | 131/302 |
| 4,081,991 | 4/1978 | Powers | 198/339 |
| 4,206,695 | 6/1980 | Cretors | 99/323.9 |
| 4,253,474 | 3/1981 | Hibbitts et al. | 131/291 |
| 4,340,073 | 7/1982 | de la Burde et al. | 131/291 |
| 4,398,548 | 8/1983 | van Weert | 131/306 |

*Primary Examiner*—Richard J. Apley
*Assistant Examiner*—Gregory Beaucage
*Attorney, Agent, or Firm*—Stonebraker, Shepard & Stephens

[57] ABSTRACT

A method and apparatus for treating tobacco leaves by impregnating them with liquid carbon dioxide under high pressure. Tobacco leaf containers, in the form of open buckets, are mounted on a turntable which rotates intermittently step by step. In the preferred apparatus, the buckets are mounted in pairs, and when one pair of buckets is at a filling station, the buckets are filled with tobacco. The turntable then rotates to bring this filled pair of buckets to an impregnating station, while another pair of buckets is brought around to the filling station. At the impregnating station, lids are tightly applied and sealed to the buckets, and the impregnating liquid carbon dioxide is introduced, held for a predetermined time, and then released, after which the lids are removed. The turntable then moves to carry the buckets to a discharge station where they are tilted to discharge the contents, and at the next increment of movement, the buckets are brought to a cleaning station where they are cleaned, special attention being given to the rims of the buckets so as to dislodge all particles which might interfere with tight sealing of the covers. The next increment of motion of the turntable carries the cleaned buckets to the filling station, where they are filled and the cycle is repeated.

18 Claims, 9 Drawing Figures

METHOD AND APPARATUS FOR TREATING TOBACCO

BACKGROUND OF THE INVENTION

This invention relates to the treatment of tobacco.

Much work has been done in the past in treating tobacco with the aim of improving its taste, aroma, burning and keeping qualities, the removal of undesirable components, and a variety of other improvements, mostly for commercial reasons. The present invention relates to the last of these reasons.

One of the treatments currently in use is impregnating raw tobacco leaf with liquified gas under pressure. Among the liquified gases used for the purpose are freon and carbon dioxide.

The use of freon, although advantageous because of lower pressure requirements, is less desirable than carbon dioxide due to potential health and pollution hazards. Liquid carbon dioxide, although not presenting these hazards, or at least not to the same degree, is a more difficult medium, as this process requires much higher pressure.

Equipment generally used with existing $CO_2$ impregnating systems requires extensive factory space, very large $CO_2$ storage and pumping equipment, complicated conveying and handling machinery, and taking it all together, a very expensive plant. In addition to that, the batch sizes to adequately meet output needs of a given operation are such, that the volume of the impregnating container discharges frozen (impregnated) tobacco in a "cake" size too large to be handled in subsequent processes without prior breaking into smaller volumed cakes (clumps). This, apart from requiring additional equipment, causes serious disintegration of tobacco leaf, producing a high percentage of fines (dust), reducing the sales value of the product.

The object of the present invention is the provision of an improved method and improved apparatus for treating tobacco leaf with an impregnating liquid.

Another object is the provision of apparatus so designed and constructed that the operation of such apparatus is largely automatic, requiring only a minimum of attention, and that the disintegration of the tobacco leaf being treated is greatly reduced as compared with prior systems:

Further objects are the provision of treating apparatus requiring less space, smaller $CO_2$ storage, handling, and pumping equipment, avoiding the use of complex, very expensive overhead crane systems, relatively easier and less expensive maintenance and service requirements, and, in total considerably less expensive installation to provide the same hourly output of impregnated tobacco leaf compared to that of existing systems.

SUMMARY OF THE INVENTION

According to the invention, a series of small sized impregnating vessels in pairs are carried on a horizontally rotating frame or turntable. These impregnating vessels or buckets have open tops with closed sides and bottoms, and are arranged to swing on horizontal pivots from upright positions downward to discharging or dumping positions. The buckets are arranged in pairs with a single tilting mechanism effecting the tilting of two buckets mounted side by side. Various pairs of buckets are mounted at intervals around the periphery of the turntable.

The turntable indexes step by step to bring a pair of buckets successively to their respective operating stations, there being four operating stations in each cycle. They are, successively: a filling station, an impregnating station, a discharge station, and a cleaning station, then the next step in the cycle is again a filling station. A small unit would have a turntable carrying only four pairs of buckets with the four stations of the cycle arranged at 90° intervals. Preferably, however, the turntable should be large enough to carry eight pairs of buckets with indexing steps of 45° from station to station. Thus, there are two filling stations arranged diametrically opposite to each other on the periphery of the turntable, two impregnating stations, two discharge stations, and two cleaning stations.

When a bucket pair is at the filling station, each bucket of the pair will have just left the cleaning station, and will be clean and empty and in an upright position. While the bucket is in this position at the filling station, it will be filled with the desired quantity of tobacco leaf, by an automatic filling device of conventionally known kind, the details of which are not part of this invention. The turntable then turns 45°, bringing the two filled buckets to the impregnating station. At this station, lids carried by a mechanism mounted on the stationary frame of the machine descend, one on top of each bucket. This arrangement permits one pair of lids at each filling station to serve pairs of buckets as they enter into the filling station. The locking arrangements for the lid will be of a conventional bayonet or similar type effected by automatically controlled lid rotation, or in the case of a bolt type mechanism, a bolt locking motion. Incorporated interlocking safety devices will prevent either pressurization, if the impregnator covers are not securely locked, or opening and removal of the impregnator covers if internal pressure is higher than atmospheric. After locking and testing the system, ensuring that the safety provisions have been met, liquified gas is pumped in the now sealed bucket through automatically controlled valves and flexible hoses.

When the time interval for the impregnating treatment is over, pressure is relieved through the hose connection and valve. Atmospheric pressure condition is tested and, if cleared, the cover is unlocked and lifted clear of the buckets. The turntable then turns 45° carrying the buckets to the discharge station. At the same time, another filled pair of buckets arrives at the impregnation station, repeating the previously described process. The buckets at the discharge station are tilted downward to the discharge position discharging treated tobacco leaf into a receiving chute. To assist discharge, the impregnator vessels or buckets are conical in shape and a short blast of compressed air injected through the bottom of the impregnating vessel assists discharge. This completes the treatment of the tobacco leaf so far as the present invention is concerned. The tobacco leaf goes on to further processing which is not part of the present invention.

In the next cycle of operation, the turntable turns a further 45° and an empty pair of buckets arrive at the cleaning station. At this station a rotating brush assembly, together with air jets, are extended forward into the still tilted dual bucket location and a rotating brush and air jet assembly performs a cleaning operation on each bucket. This completed, the buckets are returned back to the upright position, and the turntable turns through another 45°, bringing the buckets back to a filling station ready to repeat the cycle of operations as described above.

DESCRIPTION OF THE PREFERRED EMBODIMENT

Figure 1:
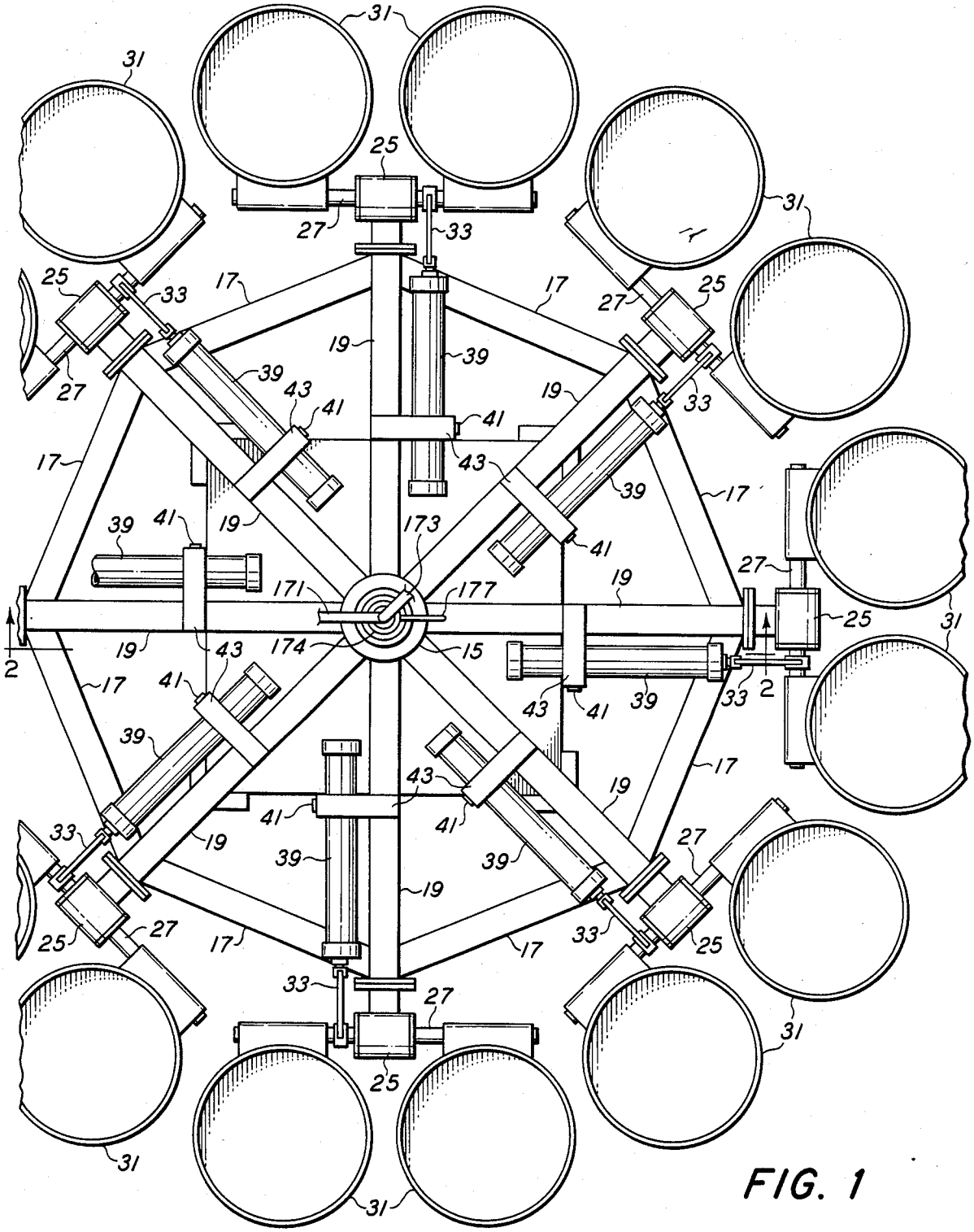
FIG. 1 is a general plan view, with parts broken away and parts omitted, of apparatus in accordance with a preferred embodiment of the invention.

A preferred embodiment of apparatus according to the present invention is illustrated in the accompanying drawings. There is a central stationary upright member or post 11 (FIGS. 1 and 2) having suitable bearings for supporting a rotary turntable indicated in general at 13. This turntable may be constructed in a variety of ways, but is conveniently made up of a tube or sleeve 15 rotating on the stationary post 11, and a series of horizontal members 17 which collectively form the polygonal periphery of the turntable, these members 17 being attached to and supported by an upper set of radial arms 19 which extend obliquely upwardly to the top of the rotary sleeve or tube 15, and a lower set of radial arms 21 which extend obliquely downwardly from the peripheral members 17 to the bottom of the rotary tube 15.

Mounted on the periphery of the turntable are impregnating vessels or buckets, preferably arranged in pairs. As best seen in FIG. 1, the turntable preferably is octagonal, and has eight pairs of buckets thereon, one pair being mounted at each corner of the polygon. At each corner there is a fixture 25 forming a bearing for a horizontal shaft 27 which projects at both ends beyond the bearing. Each end of the shaft carries a bucket 31, so that there are two buckets on each shaft at each corner of the polygonal turntable. These buckets are fixed rigidly to the shaft so as to swing upwardly and downwardly as the shaft is turned.

Each of the shafts 27 also carries an arm 33 fixed to it. The free end of each arm 33 is pivoted at 35 to the piston rod 37 of a piston within the pneumatic cylinder 39, the cylinder being pivoted at 41 to a yoke 43 carried by one of the inclined members 19 of the turntable.

Figure 3:
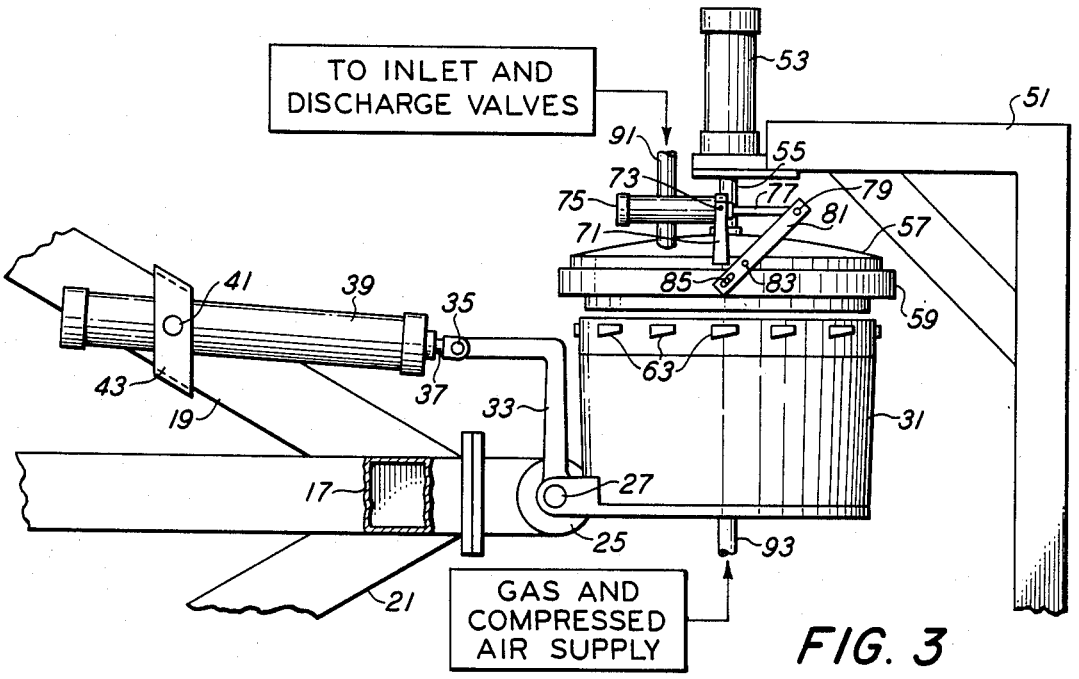
FIG. 3 is an elevational view, with parts in section, of a portion of the apparatus, illustrating particularly one of the tobacco holding buckets at the impregnating station, with the bucket cover positioned above the bucket ready to be lowered to closed and locked position.
Figures 4, 5:
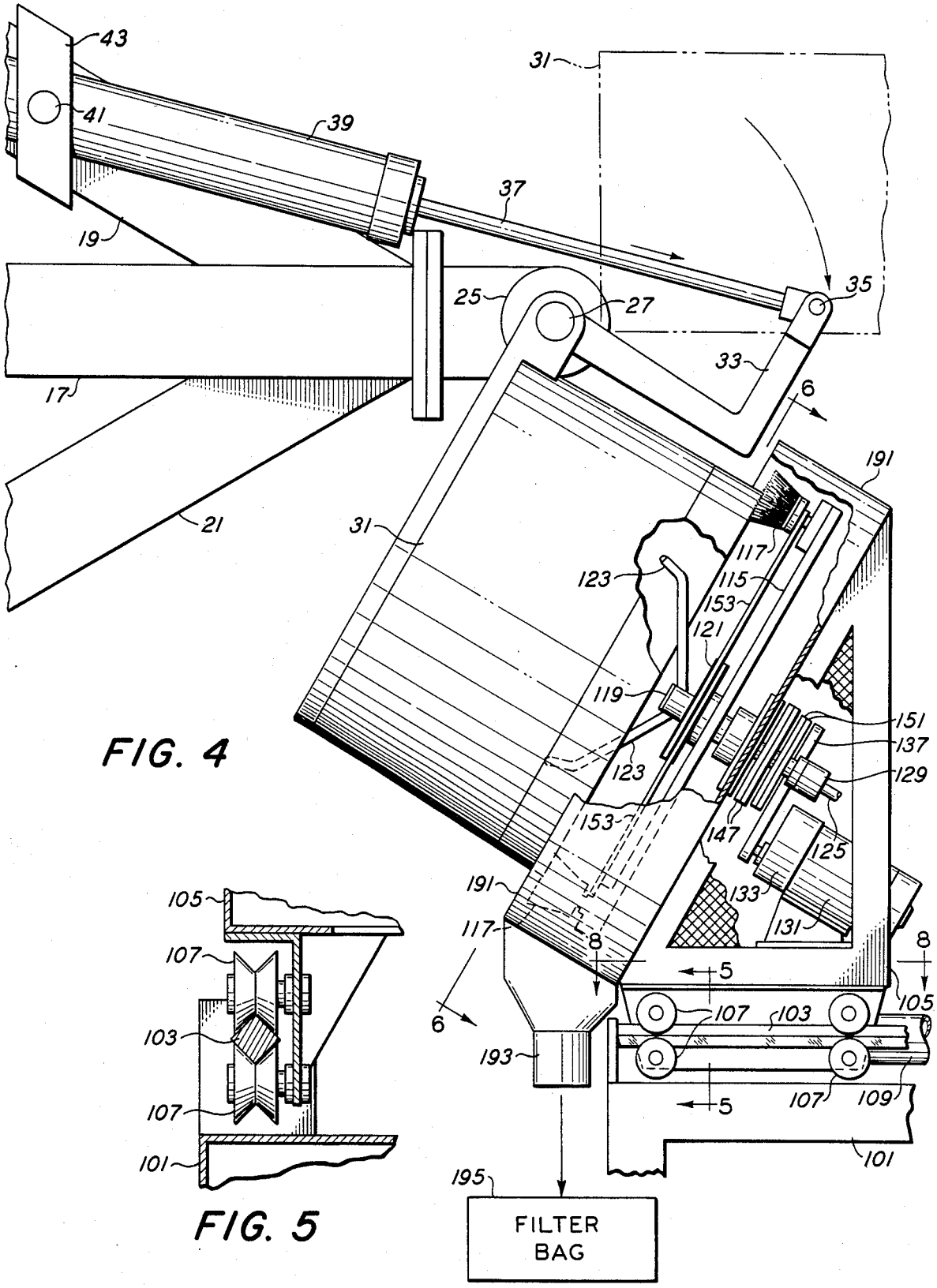
FIG. 4 is a fragmentary side elevational view, with parts broken away and parts in section, of a bucket at the cleaning station, illustrating the bucket tilted downwardly to cleaning position and with the cleaning mechanism operating on it.
FIG. 5 is a fragmentary vertical section taken approximately on the line 5—5 of FIG. 4.

In the normal upright position of the buckets, as illustrated in FIG. 3, the piston rod 37 of the cylinder 39 is retracted to its innermost position, and both buckets of the pair attached to the same shaft 27 are in the upright position illustrated. This is the position they occupy when they are at the fill station and at the impregnating station (see station diagram, FIG. 9.) The filling and impregnating parts of the cycle will be further described below. As the turntable turns to bring a pair of buckets around to the discharge station, the pneumatic cylinder 39 is operated to extend the piston rod 37 to its maximum extent as illustrated in FIG. 4, and both buckets of the pair on the same shaft are tilted downwardly to discharge the impregnated contents into a receiving chute. The discharge operation will be further described below, the description at this point relating more to the bucket tilting mechanism. Then, while still in the downward tilted position, without further operation of the pneumatic cylinder, the buckets are carried around by the next increment of rotation of the turntable, to the cleaning station, where the buckets are cleaned in a manner described below. When cleaning is completed, the turntable is indexed once more through another increment of its rotation, carrying the cleaned buckets to the filling station, and the pneumatic cylinder 39 is operated to retract the piston rod 37, thereby moving the buckets up again from the tilted position of FIG. 4 to the upright position of FIG. 3.

Referring now to the bucket lid or cover operating mechanism, illustrated in FIG. 3, there is a stationary support 51 at the side of the machine, carrying two vertically arranged pneumatic cylinders 53, only one of which shows in FIG. 3 because the other is hidden behind it. The piston rod 55 of each cylinder projects through the lower cylinder head and carries, at its lower end, a lid member 51 engaged with vertical guides (not shown) which prevent rotation of the lid but allow it to move vertically. A locking ring 59 is rotatable externally on a depending flange of the lid. This locking ring has internal bayonet lugs adapted to mate with and lock in a tight wedging manner with the stationary bayonet lugs 63 extending circumferentially around the periphery of the bucket 31 near the top edge thereof.

When the two buckets of a pair have been filled and come around to the impregnating station, they stop under the two lids 57 carried by the piston rods of the two cylinders 53 at the impregnating station. Initially, the lids are at an elevation slightly above the top edges of the buckets. Then the cylinders 53 are operated to lower the lids 57 onto their respective buckets, making a pressure-tight contact therewith.

For operating the locking rings, to lock the lids firmly to the buckets, each lid carries an upright bracket 71 to which is pivoted at 73 a small pneumatic cylinder 75, the piston rod 77 of which is connected at 79 to the upper end of a lever 81 pivoted at 83 on a fixed pivot on the lid 57. The lower end of the lever 81 has a longitudinal slot which receives a pin 85 projecting from the locking ring 59. Thus by operating the cylinder 75 to move its piston rod 77 in one direction or the other, the locking ring 59 is rotated relative to the lid in one direction or the other, through a fraction of a revolution sufficient to lock or unlock the bayonet lugs within the ring with respect to those on the periphery of the bucket. When locked, the ring holds the lid firmly down tightly on the top of the bucket.

As will be further described below when describing the operation of the machine as a whole, liquid $CO_2$ is introduced, when the lid is locked in closed position, through a flexible connection such as a hose 91, connected to the lid 57. This occurs only when a bucket is at the impregnating station, as this is the only time when a lid is on the bucket. There is also a flexible hose connection 93 to the bottom of the bucket, through which $CO_2$ gas may be introduced at one time, and compressed air at another time, as explained below.

Reference is now made to FIGS. 4–8, illustrating the cleaning mechanism. When the impregnating step at the impregnating station is completed, the buckets move to the discharge station and are tilted downwardly so that the cake of impregnated tobacco leaf drops out of each bucket and into a receiving chute, not shown. The discharge of the impregnated cake is assisted by a short blast of compressed air applied to the bottom of the bucket through the above mentioned connection 93, and the discharge is easy also because the buckets are slightly tapered or frusto-conical in shape. In most cases the impregnated tobacco will discharge as a rather solid cake, leaving the interior of the bucket relatively clean, and requiring only minimum attention before the bucket is refilled. However, the rim of the bucket needs careful attention and thorough cleaning to make sure that no particles of tobacco leaf stick to the rim, which would interfer with the tight seal of the lid which is required for maintaining the high internal pressure during the next impregnating operation.

Figure 8:
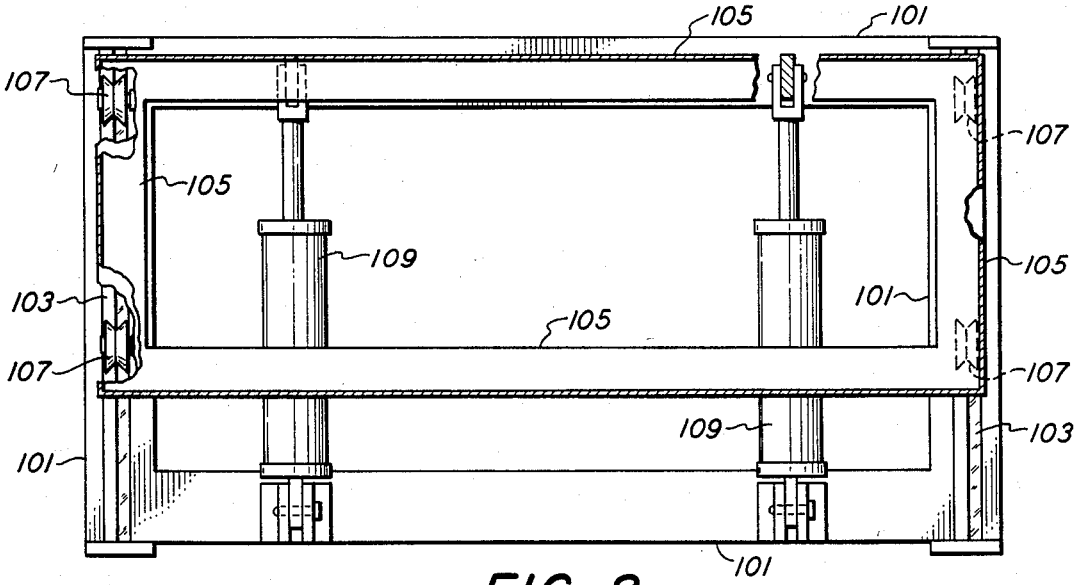
FIG. 8 is a section taken approximately on the line 8—8 of FIG. 4, illustrating part of the carriage on which the cleaning mechanism is mounted.

To accomplish this, the apparatus includes the cleaning mechanism which will now be described. Referring first to FIGS. 4, 5, and 8, a stationary support 101 at the side of the turntable carries a pair of rails or tracks 103 extending in a generally radial direction toward and away from the central post 11 of the machine, at the cleaning station location. On these rails 103 is a small carriage 105, having wheels 107 which engage the rails both above and below, to prevent any tilting or cocking of the carriage 105. A pair of pneumatic cylinders 109 operatively connected to the carriage 105 serves to move the carriage along the rails 103, to position it in a forward position close to a pair of buckets when the cleaning mechanism is operating on the buckets as illustrated in FIG. 4, or a retracted position (not illustrated) further away from the buckets, to allow adequate space for the buckets to be tilted upwardly and to move past the cleaning mechanism as the turntable indexes to the next position.

The carriage 105 has bearings for two parallel hollow shafts 113 (see FIG. 7) which at their forward ends carry diametrical rotor members 115 (FIGS. 4, 6, and 7) which rotate with the shafts 113. At each end of each rotor member, there is a bearing for a rotary brush 117.

Figure 6:
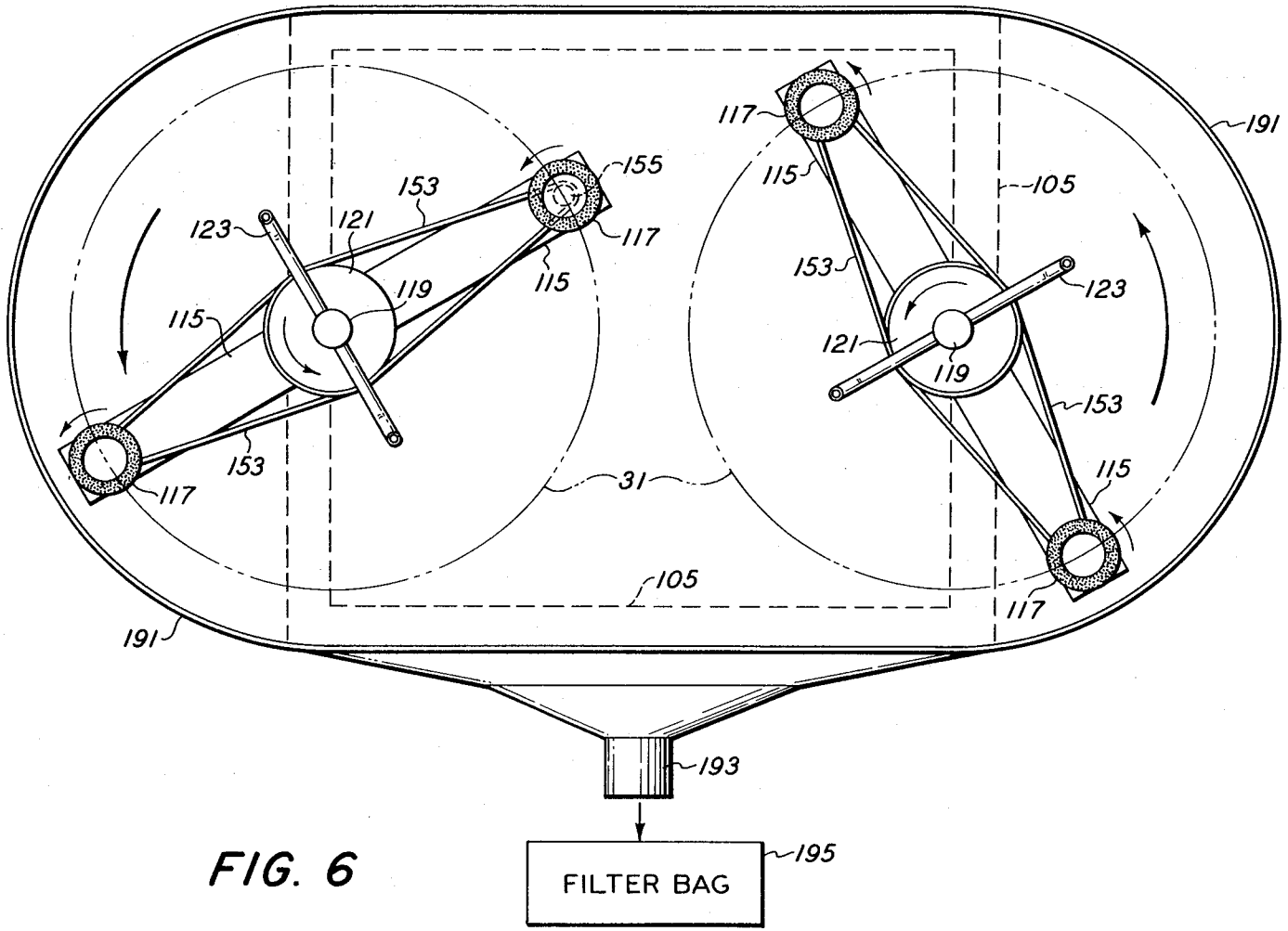
FIG. 6 is a section taken approximately on the line 6—6 of FIG. 4, illustrating the bucket cleaning brushes and other parts of the cleaning mechanism.

A second hollow shaft 119 extends through and is rotatable within each of the above mentioned hollow shafts 113 and has a forward end projecting forwardly beyond the rotor 115, this projecting forward end being visible in FIGS. 4 and 6. This forward end carries two pulleys 121 fixed to the shaft 119 to rotate with it, and in front of the pulleys it carries a pair of air nozzles 123 arranged diametrically with respect to each other as illustrated FIGS. 4 and 6. Compressed air is supplied to the rear end of each of the hollow shafts 119 through supply lines 125 (FIGS. 4 and 7) from any suitable source such as illustrated schematically at 127, the supply lines being connected to the rear ends of the respective shafts through rotatable air couplings 129.

Figure 7:
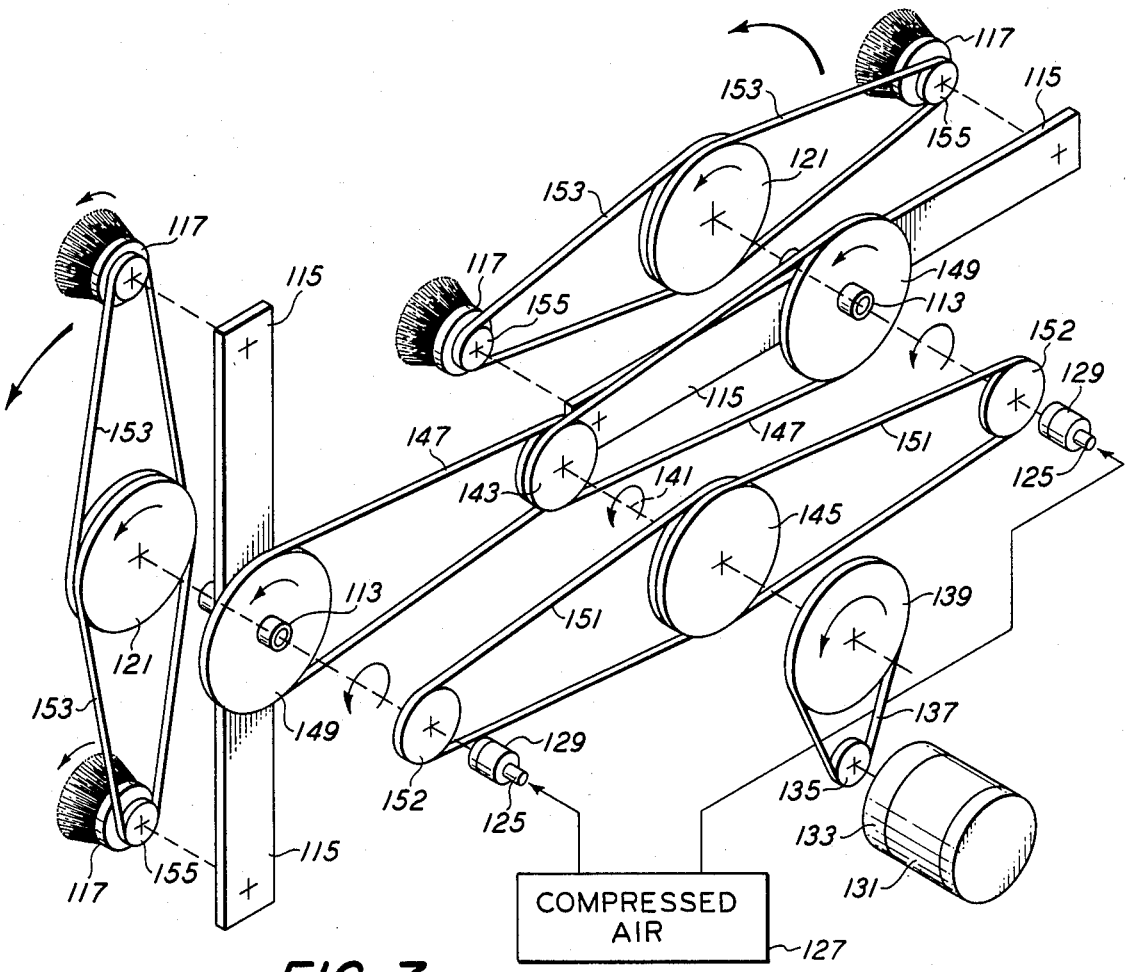
FIG. 7 is an exploded schematic view of the cleaning brush drive and associated parts.

The drive of the moving parts of the cleaning mechanism is from an electric motor 131 mounted on the carriage 105. Through a reducing gear box 133, the drive continues (as best seen in FIG. 7) through a small pulley 135 on the output shaft of the gear box, which is connected by a belt 137 to a larger pulley 139 fixed to the main drive shaft which is schematically indicated by the broken line 141 representing its axis.

Fixed on this main drive shaft 141 are two pairs of pulleys, a pair of relatively small pulleys 143, and a pair of relatively larger pulleys 145. The two pulleys 143 are connected by respective drive belts 147 to respective larger pulleys 149 fixed to the respective hollow drive shafts 113 which drive the rotors 115. The other pair of pulleys 145 on the main drive shaft are connected by respective belts 151 to the respective smaller pulleys 152 fixed to the inner hollow shafts 119 which drive the rotary brushes. The large pulleys 121 fixed to each shaft 119 near the forward end thereof are connected by belts 153 to respective smaller pulleys 155 on the rotary brushes.

Because of the relative sizes of the various pulleys as mentioned above, it is seen that the shafts 113 aand the members 115 carried by them will rotate relatively slowly, while the shafts 119 will rotate in the same direction as the shafts 113 but will rotate faster, and the large pulleys 121 on the shaft 119 will drive the small pulleys 155 on the brushes at a much faster rate. When the cylinders 109 are operated to move the carriage 105 inwardly toward the central post 11, this positions the brushes 117 against the rims of the two buckets or containers 31 which at that time are located at the cleaning station. The net result is that, by operation of the motor 131, the brushes 117, while rotating rapidly on their own axes, revolve around the rims of the respective buckets 31 with which they are in contact, thoroughly cleaning the rims of the buckets and removing any scraps of tobacco leaf that may adhere thereto. At the same time, the air nozzles 123 mounted on the forward ends of the shafts 119 rotate with these shafts, and air jets from these nozzles blow out any remaining fragments of tobacco leaf from the side and bottom walls of the buckets.

After a short interval of operation of the cleaning mechanism, the cylinders 109 are operated to withdraw the carriage 105, moving it radially outwardly away from the central post 11, retracting the brushes from the rims of the buckets which have just been cleaned, sufficiently far to allow these buckets to move onward during the next partial rotation or indexing motion of the bucket supporting turntable. The buckets which have just been cleaned then arrive at the filling station (see the station diagram, FIG. 9) and are moved to their upright receiving positions by operation of the cylinder 39 connected to this pair of buckets.

The electrical control connections and the fluid supply connections may be made in any desired manner according to conventional engineering practice. For example, referring to FIG. 1, there may be a compressed air supply inlet 171 at the top of the central post 11, and a separate inlet connection 173 for compressed $CO_2$ gas also at the top of the stationary central post 11. Through the conventional rotary fitting 174, these supply compressed air and $CO_2$ gas, respectively, to the tubes or hoses 175 and 177, respectively, which are mounted on the rotatable turntable structure indicated in general at 13 in FIG. 1. These tubes or hoses (which may be referred to broadly as conduits) have various branches (of conventional construction and therefore not illustrated in detail) which include compressed air conduits leading, through separate electrically controlled valves, to both ends of each of the cylinders 39 and to the hoses 93 for the bottoms of each of the buckets. Also the conduits for the compressed $CO_2$ gas lead through electrically controlled valves to the flexible hoses 93 which enter the bottoms of the buckets.

As above stated, the flow of gas (whether it be compressed air or $CO_2$) is controlled by electrically operated valves which are themselves of conventional known design and so are not illustrated, these valves being located on any suitable part of the turntable structure 13. There is a separate compressed air control valve for each individual conduit branch leading to each end of each cylinder 30 and to each bucket, and a separate gas gupply control valve for each connection 93 to the bottom of each bucket 31. The cylinders 39 are so-called double acting cylinders, and their control valves may conveniently be of the conventional kind known as 5-port directional control valves, which exhaust to atmosphere.

The electrical connections for operating the various control valves enter the system at any desired point. Preferably an electrical control cable carrying the desired number of separate conductors for the necessary number of control circuits enters the stationary post 11 near the bottom thereof, as shown at 179 in FIG. 2. The circuit connections from the control cable 179 go through slip rings indicated schematically at 180 to the conductors located on the turntable and leading to the individual fluid-control valves.

Figure 2:
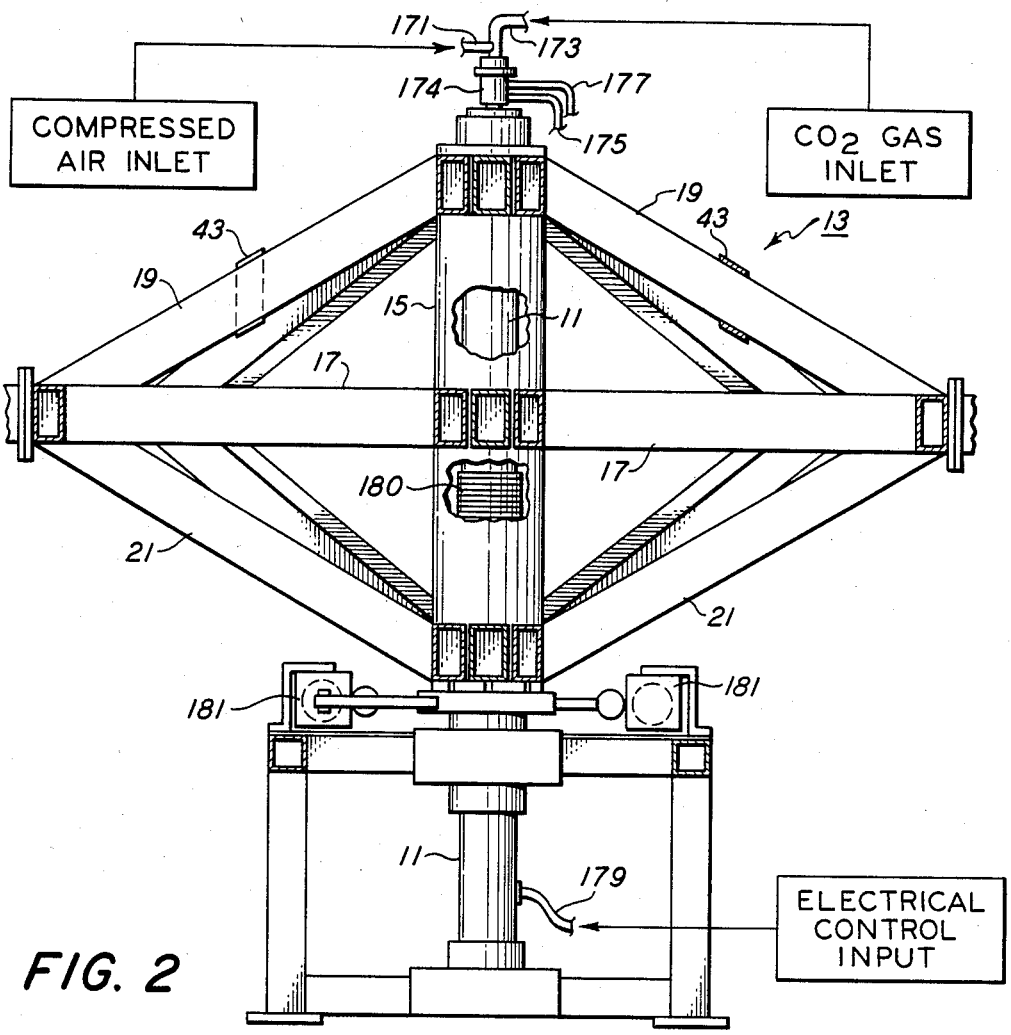
FIG. 2 is a vertical section taken approximately on the line 2—2 of FIG. 1.

The indexing mechanism, for turning the turntable through the proper controlled amount (45 degrees, in the preferred form here shown) at each cycle of operation, is a conventional compressed air operated indexing mechanism of known construction, schematically indicated at 181 in FIG. 2. The details are not important for purposes of the present invention; any conventional indexing mechanism which will turn the turntable the desired amount at each operation would be satisfactory. Conventional controls serve to activate the indexing mechanism to turn the turntable in proper timed or synchronized relation to the other operations.

In addition to the above mentioned compressed air and gas connections which relate to the turntable, there are also compressed air connections (not shown) with conventional control valves leading to the cylinders 109 (FIGS. 4 and 8) which move the cleaning carriage forwardly and backwardly, and there are both compressed air and treating medium connections (again conventional and not shown) with suitable control valves for the cover or lid mechanism. The compressed air connections go to both ends of the vertical cylinder 53 which moves the cover 57 upwardly and downwardly, and to both ends of the cylinder 75 which operates the locking mechanism for locking the cover tightly on the top of the bucket or container while the high pressure treating step is being performed. All of the penumatic cylinders are double-acting. A treating medium conduit goes, through an electrically operated control valve and a flexible conduit, to the inlet 91 in the top of the cover or lid 57.

The electrical circuits for operating the various control valves in the supply and exhaust conduits are activated from a central timing or control unit or panel of conventional kind well known in the art, which need not be illustrated as the details thereof are unimportant for purposes of the present invention. The various circuits are activated in sequence to perform the following operations which will now be summarized.

The operation of the mechanism can best be understood by following the progress of a single pair of buckets or containers, that is, the two buckets mounted on a single shaft 27. Of course all of the pairs of buckets (eight pairs or 16 buckets in the complete machine here illustrated) ultimately go through the same cycle.

Figure 9:
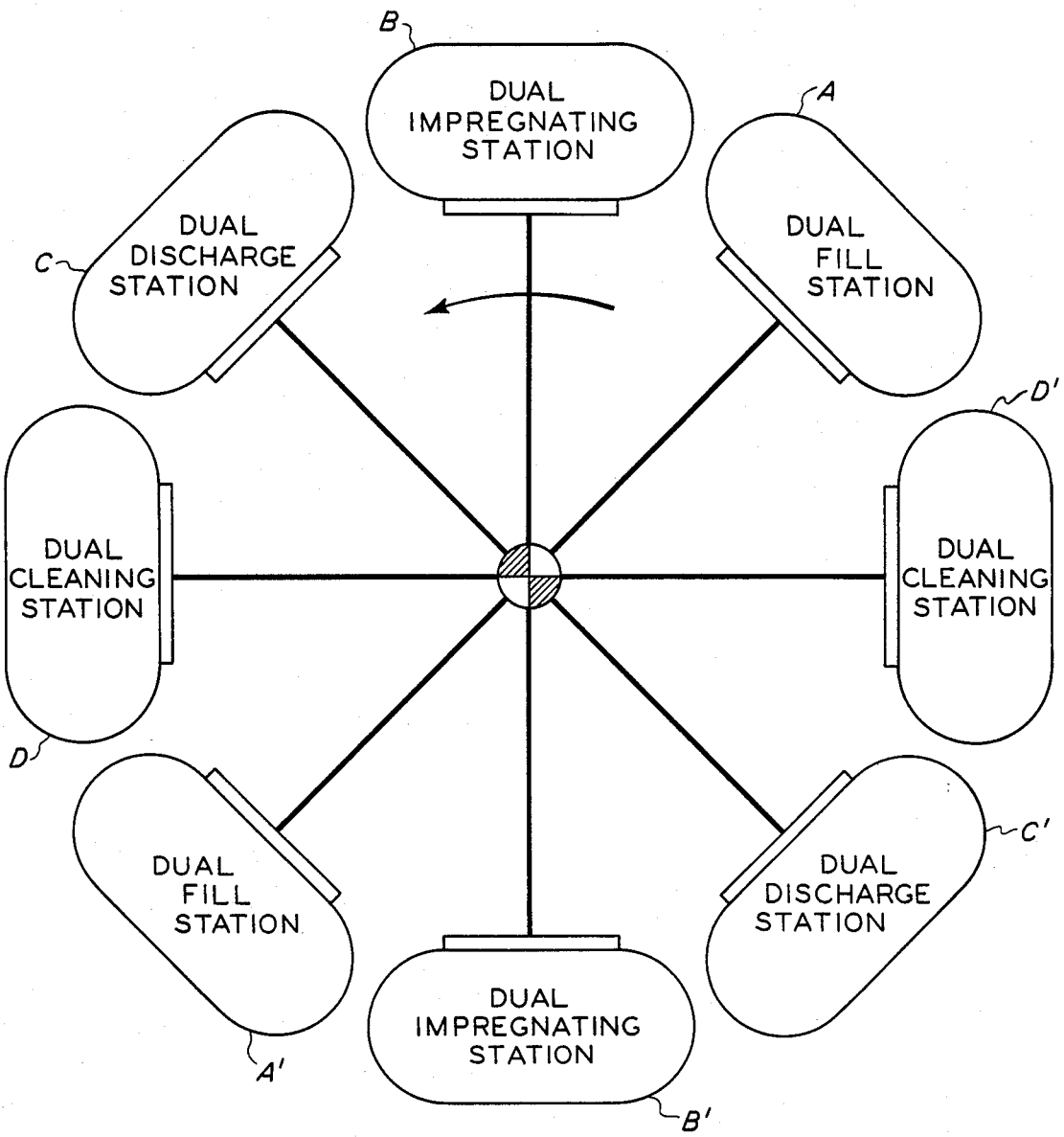
FIG. 9 is a diagram illustrating the positions of the bucket stations.

Assume that a pair of buckets is at a filling station (either one of the two filling stations marked A and A' in the diagram of FIG. 9). The two buckets at the filling station will be in the upright position shown in FIG. 3, except that there will be no lid or cover over these buckets. While in this position, the mechanism being stationary for the moment, a load of the desired quantity of tobacco leaf is placed in each of the buckets. As already mentioned, this is done by conventional filling mechanism which forms no part of the present invention.

When filling is completed, the timing or synchronizing mechanism operates the valves controlling the flow of compressed air to the indexing mechanism 181, to operate the indexing mechanism through one cycle, which causes the turntable 13 to turn 45 degrees in a counterclockwise direction (as viewed from above) carrying the pair of buckets from the filling station A of FIG. 9 to the impregnating station B of FIG. 9. Of course all of the other pairs of buckets move around one step from the previously occupied station to next station, but we will confine our description to the single pair of buckets which we are now considering.

At this impregnating station B, the buckets which were previously filled at station A, are now positioned beneath the cover or lid mechanism illustrated in FIG. 3. While the buckets remain stationary in this position, the cylinder 53 is operated to lower the two lids 57 onto the tops of the two buckets at this station, and then the cylinder 75 on each of the lids is operated to cause a slight rotation of the locking ring 59 on each lid, to engage the bayonet lugs so as to lock each lid firmly in place on the top of each bucket.

The impregnating medium (liquid $CO_2$ in the preferred embodiment of the invention, but it could be any other desired treating medium so far as the mechanical construction of the parts is concerned) is then introduced under high pressure through the conduit 91 leading into the lid or cover of each of the buckets at this station, while the lid remains locked in place by the locking ring 59. Conventional procedures may be used to test for tightness of seal of the covers on the buckets and for safety of locking the covers in place, before the high pressure treating medium is introduced.

After the treating by the liquid $CO_2$ (or any other desired treating medium) has continued for the desired time, the control valves in the supply lines leading to the covers of the two buckets at the impregnating or treating station B are operated to allow the residue of liquid $CO_2$ to exhaust from these two buckets back to the liquid $CO_2$ reservoir. At this time, the valves in the compressed $CO_2$ gas lines leading to the bottoms of these two buckets are operated to introduce $CO_2$ gas, to expell the residue of liquid $CO_2$ through the hose connections to the lids. Then the lines to the buckets are vented to atmosphere, restoring the pressure in these buckets to a normal atmospheric pressure. After a safety test to make sure no pressure remains, the cylinders 75 on the locking rings of the covers of these two buckets are again operated in the reverse or unlocking direction, to unlock the lids, and the cylinder 53 is operated to raise the lids to a position slightly above the top edges of the buckets, being the position illustrated in FIG. 3.

Then the valves controlling compressed air to the indexing mechanism 181 are operated to cause another cycle of operation of the indexing mechanism. This turns the turntable 13 through one more increment of motion, 45 degrees counterclockwise, bringing the buckets under consideration to the discharge station indicated at C in FIG. 9, while another pair of buckets is brought around to the impregnating station B and a different pair of buckets is brought around to the filling station A.

When the buckets under consideration reach the discharge station C, the valves controlling the flow of compressed air to the cylinder 39 for this particular pair of buckets are operated to tilt the buckets down to the discharge position. This is the position illustrated in FIG. 4, although at this time the cleaning mechanism also shown in FIG. 4 will not be present, because it is not at this station but at the next station. While the buckets are in this downwardly tilted position at the discharge station C, the treated tobacco leaf mass is discharged into a conventional receiving chute, the discharge usually taking place by gravity, assisted if necessary by a short blast of compressed air delivered to the bottom of each bucket through the flexible conduit connection 93. As already stated above, what happens to the tobacco after it leaves the buckets is no part of the present invention.

Next, the valves controlling air supply to the indexing mechanism 181 are again operated to cause one more indexing operation of this mechanism, which turns the turntable through another 45 degrees, carrying the pair of buckets we are considering onward to the cleaning station indicated at D in the diagram of FIG. 9. Of course this also brings another pair of buckets from station B to station C, and another pair of buckets from station A to station B, and so forth.

When the pair of buckets we are considering reaches cleaning station D, these buckets are still in the downwardly tilted position shown in FIG. 4. At the time the buckets move to this cleaning station position, the carriage 105 of the cleaning mechanism is retracted to a position rightwardly from the position shown in FIG. 4, so that no parts of the cleaning mechanism are in the path of travel of the buckets as the turntable turns. While the buckets are stationary in this position, the valves which control the air supply to the cylinders 109 (FIGS. 4 and 8) are operated to cause these cylinders to move the cleaning carriage 105 forwardly, bringing the cleaning brushes 117 (FIGS. 4, 6, and 7) against the rims of the empty buckets, and putting the air nozzles 123 (FIGS. 4 and 6) in positions slightly inside the buckets. The motor 131 then operates to cause the carriers 115 to turn to carry the two sets of brushes 117 around the respective rims of the two buckets, while at the same time these brushes are rapidly rotating. This action thoroughly cleans the rims of the buckets from any particles of tobacco leaf or other foreign matter that may tend to stick to the rims, which might interfer with the tight seal required during the high pressure impregnating or treating step of the process. While this cleaning of the rims is going on, the air nozzles 123 are rotating inside the buckets, and compressed air is supplied to these nozzles through the connections 125, and this compressed air adequately cleans out any stray tobacco that may have accidentally remained in the bucket when the load was dumped at the discharge station. Dislodged particles collected in the housing 191 go down the chute 193 to a filter bag or other collector 195.

At the conclusion of the cleaning operation, the air supply to the carriage cylinders 109 is reversed, and the carriage 105 is retracted, to move the brushes 117 away from the rims of the the buckets and to carry air jet nozzles 123 to a position outside of the buckets. The cleaning drive motor 131 is preferably shut off, although if desired the motor may be kept running continuously. Then the indexing mechanism 181 is operated once more, to turn the turntable through another increment of 45 degrees, which carries the pair of buckets we are considering around from the cleaning station D of FIG. 9 to another filling station A′ which is diametrically opposite to the other filling station A previously considered. When the buckets reach this filling station A′, or possibly while they are still traveling on the way from cleaning station D to filling station A′, the valves controlling the air supply to the cylinder 39 of these buckets are operated to raise the buckets from the down-tilted position of FIG. 4 to the upright position, ready to receive a new load of tobacco leaf at this filling station A′, the same as was previously received at the other filling station A. The cycle continues indefinitely in this manner, in a sequence which will now be obvious from what has been explained above.

As already indicated, a smaller machine can be built, if desired, having only four stations. It is believed to be more economical, in general, and is therefore preferred, to build the machine in a larger size having a total of eight stations as indicated in the diagram of FIG. 9, with pairs of duplicate function stations at opposite diametrical points around the periphery of the turntable. The result is an economically feasible machine for carrying out the desired process in a feasible and economical manner, fairly rapidly and automatically once the machine has been set into operation and so long as it is kept supplied with the necessary quantity of tobacco leaf to be loaded successively into the buckets. Very little attention or supervision should be needed, once the machine has been properly set up and started.

What is claimed is:

1. Tobacco treating apparatus comprising a rotary structure, a series of tobacco containers mounted on said rotary structure in circumferentially spaced relation to each other, means for turning said rotary structure incrementally step by step, means forming a series of operating stations in locations spaced circumferentially around said rotary structure, said stations including in circumferential succession a filling station, an impregnating station, a discharge station, and a cleaning station, said stations being so located with respect to said containers on said rotary structure that as said rotary structure turns to carry one container from said filling station to said impregnating station another container will be carried from said impregnating station to said discharge station and another container will be carried from said discharge station to said cleaning station and so on, each of said containers being an open top container adapted to receive a load of tobacco when at said filling station, means for applying a pressure-tight cover to a container at said impregnating station, means for introducing an impregnating medium into said the covered container at said impregnating station, means for removing the cover from the container at said impregnating station after an interval of treatment by said impregnating medium, means for removing the treated tobacco from a container at said discharge station, and means for cleaning the empty container at said cleaning station to make it ready to receive a new load of tobacco.

2. The invention defined in claim 1, wherein said containers are in the form of buckets pivotally mounted on said rotary structure to swing from an upright load-receiving and load-carrying position to a downwardly tilted position for discharge of contents.

3. The invention defined in claim 2, wherein said buckets are of frusto-conical tapered shape.

4. The invention defined in claim 2, further comprising a flexible conduit opening into the bottom of each bucket, for introducing compressed air into the bucket.

5. The invention defined in claim 2, further comprising a flexible conduit opening into the bottom of each bucket for introducing compressed gas into the bucket.

6. The invention defined in claim 1, wherein said containers are mounted on said rotary structure in pairs, with two buckets of each pair arriving together at each successive operating station.

7. The invention defined in claim 1, wherein said means for cleaning an empty container includes brush means for brushing a rim portion of said container and air jet means for impinging upon inner surface portions of said container.

8. The invention defined in claim 1, wherein said means for cleaning an empty container includes a carriage, rotary brush means mounted on said carriage, and means for moving said carriage from a retracted position in which said brush means is out of contact with said container to an advanced position in which said rotary brush means is engaged with a portion of said container.

9. The invention defined in claim 8, wherein said rotary brush means includes a rotor member extending approximately diametrically with respect to a container being cleaned and mounted for rotation about an axis approximately concentric with said container, and a pair of brushes mounted for rotation on said rotor and positioned to engage a rim of said container, and means for rotating said brushes while said rotator rotates.

10. The invention defined in claim 9, further comprising a first hollow shaft on which said rotor is mounted, means for turning said first shaft to rotate said rotor, a second shaft inside said first shaft and having one end projecting beyond said first shaft in the vicinity of said rotor, means for turning said second shaft at a speed different from that of said first shaft, and means for rotating said brushes from the rotating projecting end of said second shaft.

11. The invention defined in claim 10, wherein said second shaft is hollow, further comprising an air jet nozzle mounted on and rotating with the projecting end of said second shaft, and means for supplying compressed air to said second shaft as it turns, to form a cleaning air jet issuing from said nozzle to clean a portion of the container on which said brushes are operating.

12. Tobacco treating apparatus comprising means forming a series of operating stations arranged in a continuous circuit, a series of tobacco containers, means for moving the containers intermittently and successively from one station to the next station along said circuit, said stations including a container loading station at which a container is loaded with tobacco to be treated, a tobacco treating station at which tobacco in a container is subjected to treatment, a container discharge station at which treated tobacco is discharged from a container, and a container cleaning station at which a container is cleaned ready to receive a fresh load of tobacco, the containers being substantially open except at said treating station, means for covering and tightly sealing a container at said treating station, and means for impregnating tobacco in a sealed container at said treating station with a treating medium at a pressure substantially above atmospheric pressure.

13. The invention defined in claim 12, wherein said treating medium is liquified carbon dioxide.

14. The invention defined in claim 12, wherein each of said operating stations is a dual station, and said containers are arranged in pairs, with a pair of containers arriving at each dual operating station upon each successive advancing movement of the containers.

15. The invention defined in claim 12, wherein said containers are pivotally mounted for swinging movement between upright positions and downward inclined positions.

16. The invention defined in claim 15, further comprising fluid pressure cylinders for swinging said containers.

17. The invention defined in claim 12, wherein said means for covering and sealing a container comprises a cover member remaining at said treating station for use on successive containers as they successively arrive at said treating station, and locking means for tightly locking said cover in place on a container.

18. The method of treating tobacco with an impregnating medium which comprises the steps of (a) placing a load of tobacco in an open container in one location, (b) moving the container to a second location, (c) covering and sealing the container in said second location, (d) impregnating the tobacco in the sealed container with a treating medium at a pressure substantially above atmospheric pressure, (e) relieving the pressure in the sealed container and removing the cover thereof, (f) moving the container to a different location and discharging the treated tobacco therefrom, and (g) cleaning the container to prepare it to receive another load of tobacco;

loading, impregnating, discharging and cleaning occuring substantially simultaneously on different tobacco loads.

* * * * *